US005656109A

United States Patent [19]

Schilling et al.

[11] Patent Number: 5,656,109

[45] Date of Patent: Aug. 12, 1997

[54] METHOD OF MAKING INLAID FLOOR COVERINGS

[75] Inventors: Lee Hilton Schilling, Lookout Mountain; Lorence M. Moot, Cohutta, both of Ga.

[73] Assignee: Collins & Aikman Floorcoverings, Inc., Dalton, Ga.

[21] Appl. No.: 520,170

[22] Filed: Aug. 28, 1995

[51] Int. Cl.[6] ..... B32B 3/02

[52] U.S. Cl. ..... 156/63; 156/72; 156/258; 156/263; 156/304.7; 156/308.4; 156/308.6; 428/95; 428/88

[58] Field of Search ..... 156/72, 304.4, 156/304.7, 263, 258, 63, 98, 308.6, 308.4, 304.6; 428/95, 88, 96

[56] References Cited

U.S. PATENT DOCUMENTS

| | | | |
|---|---|---|---|
| 1,595,581 | 8/1926 | Stedman . | |
| 1,947,152 | 2/1934 | Clark . | |
| 1,959,627 | 5/1934 | Hunt . | |
| 2,012,929 | 8/1935 | Knowland . | |
| 2,245,202 | 6/1941 | Krasno . | |
| 3,484,316 | 12/1969 | Dirrim . | |
| 3,560,284 | 2/1971 | Wisotzky et al. . | |
| 3,698,973 | 10/1972 | Wisotzky et al. . | |
| 3,884,743 | 5/1975 | Kunak et al. . | |
| 3,935,046 | 1/1976 | Kiernan et al. . | |
| 4,086,113 | 4/1978 | Cataffo et al. | 156/98 |
| 4,144,366 | 3/1979 | Lewis . | |
| 4,336,289 | 6/1982 | Davis . | |
| 4,808,459 | 2/1989 | Smith et al. . | |
| 4,849,267 | 7/1989 | Ward et al. . | |
| 4,851,061 | 7/1989 | Sorkoram . | |
| 4,877,669 | 10/1989 | Endrenyi, Jr. et al. . | |
| 5,198,277 | 3/1993 | Hamilton et al. . | |
| 5,324,562 | 6/1994 | Mullinax et al. . | |

*Primary Examiner*—Michael W. Ball
*Assistant Examiner*—Sam Chuan Yao
*Attorney, Agent, or Firm*—J. Michael Martinez de Andino; McGuire, Woods, Battle & Boothe, L.L.P.

[57] ABSTRACT

A method of making a floor covering having decorative inlays therein is disclosed. The method comprises the steps of cutting and removing portions of the floor covering, providing inlays from another floor covering material having substantially the same shapes and sizes as the removed portions, and joining the inlays and floor covering to create a seamless structure. The seamless structure results from the application of a volatile solvent which causes the thermoplastic properties of the materials within the inlays and floor covering to fuse.

26 Claims, 3 Drawing Sheets

METHOD OF MAKING INLAID FLOOR COVERINGS

FIELD OF THE INVENTION

The present invention relates generally to floor coverings, and more particularly to carpets having decorative patterns inlaid therein.

BACKGROUND OF THE INVENTION

Tufted carpet is used as a floor covering in many commercial and residential facilities. Conventional tufted carpets comprise a primary backing with yarn tufts in the form of cut or uncut loops extending upwardly from the backing and forming a pile surface. Typically, the yarn is inserted into the backing by tufting needles and maintained permanently in place by a heat-sensitive coating composition (e.g., a thermoplastic resin) applied to the back surface of the primary backing. When heat is applied to the composition, the pile yarns are fused to the primary backing creating an integral tufted carpet. See, for example, U.S. Pat. No. 3,695,987 to Wisotzky et al.

Conventional tufted carpets may also include a secondary backing bonded to the primary backing. The secondary backing provides extra padding to the carpet, absorbs noise, adds dimensional stability and often functions as a heat insulator. The secondary backing can be formed from natural fibers (e.g., jute), or synthetic fibers (e.g., polypropylene), and can be a woven or non-woven material. The secondary backing can also be a foam composition comprised of urethane polymers.

The secondary backing may be bonded to the primary backing via hot-melt adhesives. See, for example, U.S. Pat. No. 3,390,035 to Sands. Alternatively, the same coating composition used to secure the tufted yarns to the primary backing may also function as an adhesive layer for bonding the secondary backing to the primary backing. See, for example, U.S. Pat. No. 4,808,459 to Smith et al.

Historically, the pile face of conventional tufted carpets was comprised of only single color yarns. However, as interior styling has become more fashionable, particularly for large commercial facilities, there has been an increase in demand for visually pleasing tufted carpets comprising various colors, designs, and patterns. One method of creating patterns and designs in tufted carpet is to insert yarns of different colors into the primary backing during manufacturing of the carpet. See, for example, U.S. Pat. No. 4,877,669 to Endrenyi, Jr. et al. See also, U.S. Pat. No. 5,198,277 to Hamilton et al. Another method involves printing different colors, patterns or designs directly on the pile face of a manufactured carpet. Unfortunately, this is an expensive post-manufacturing process and, thus, is not a very desirable method.

Yet another technique for producing visually pleasing tufted carpet involves the use of decorative inlays. In general, this technique includes the steps of cutting a carpet to create an opening having a decorative shape, placing an inlay in the opening of the carpet, and securing the inlay to the carpet. See, for example, U.S. Pat. No. 1,947,152 to Clark, U.S. Pat. No. 2,012,929 to Knowland, and U.S. Pat. No. 2,245,202 to Krasno. This is typically done by the customer or consumer, and does not permit large scale production of carpet.

Unfortunately, the existing methods of making inlaid carpet have various disadvantages. Typically, an inlay is secured within a carpet by either applying a hot melt adhesive to the abutting edges of the inlay and carpet or by applying a patch over the adjoining edges of the backing of the inlay and carpet. Unfortunately, a joint between an inlay and carpet resulting from either of these methods may be susceptible to tension when the carpet is stretched, which may result in the inlay becoming detached from the carpet. Stretching may occur during manufacturing when the carpet is convolutely wound in rolled form and also during installation. Ordinary usage from foot traffic also has the tendency to stretch the joint between the inlay and carpet, causing the inlay to become dislocated. Furthermore, none of the known methods of securing an inlay within a pile carpet completely eliminate the presence of an unsightly seam along the abutting edges of the carpet and inlay.

SUMMARY OF THE INVENTION

It is therefore an object of the present invention to overcome the deficiencies of existing inlaid carpet by providing an inlaid textile substrate having an inlay that is not susceptible to separation caused by stretching.

It is yet another object of the present invention to provide an inlaid textile substrate having an inlay wherein no visible seam exists along the abutting edges of the textile substrate and inlay.

These and other objects, features and advantages of the present invention are provided by a substantially seamless inlaid textile substrate and a method of making the same.

The method, according to the present invention, comprises the steps of creating an opening in a textile substrate; providing an inlay substantially identical in shape and size as the opening; inserting the inlay into the opening such that the inlay and the opening substantially coincide; and fusing the inlay and the textile substrate. A desired shape or pattern is selected and removed, such as by cutting, from the textile substrate to create an opening. The cutting may be performed by conventional cutting devices including an ultrasonic cutting knife, laser, wire cutter, or water jet. One or more inlays, substantially identical in shape and size as the opening in the textile substrate, are created from a second textile substrate and then inserted into the opening. The step of creating the inlay may occur substantially concurrently with the step of creating the opening within the textile substrate, and may be performed under computer control. Prior to fusing, the textile substrate and the inlay can be immobilized, such as by removable adhesion of the textile substrate and inlay to an adhesive substrate. The inlay(s) and textile substrates are preferably fused using a volatile solvent to gel or soften the thermoplastic resin coating compositions so that the inlay(s) and substrate can be joined together. The result is an inlaid textile substrate that is resistant to separation of the inlay as a result of stretching.

In another aspect of the present invention, the method of making a substantially seamless textile substrate having a decorative inlay therein may include the additional step of applying a releasable adhesive layer to the secondary backing. A cover releasably secured to the layer of pressure sensitive adhesive protects and maintains the tackiness of the adhesive layer prior to laying the floor covering on an underlying floor.

According to another aspect of the present invention, a textile substrate having a decorative inlay therein is produced. The textile substrate comprises a face layer including a primary backing, fabric secured through and to the primary backing to provide a face surface, and a secondary backing secured to the primary backing using a first thermoplastic resin coating composition. The textile substrate has one or more openings therein for receiving one or more decorative inlays. The inlay placed in the textile substrate opening has a primary backing, fabric secured through and to the primary backing to provide a face surface, and a secondary backing secured to the primary backing using a second thermoplastic resin coating composition. The textile substrate may additionally comprise a plurality of decorative inlays therein.

The inlay and the textile substrate are fused, employing the thermoplastic properties of the first and second resin coating compositions to create a substantially seamless textile substrate that resists separation of the inlay from the textile substrate caused by stretching. The resin coating compositions for both the textile substrate and inlay may comprise a polymer or copolymer of a vinyl compound, such as polyvinyl chloride. A volatile solvent can be used to fuse the textile substrate and inlay.

According to yet another aspect of the invention, a releasable adhesive layer, for securing the textile substrate to a surface, is applied to the secondary backing of both the textile substrate and the inlay. Additionally, a release cover may be applied to the releasable adhesive layer.

DETAILED DESCRIPTION OF PREFERRED EMBODIMENTS

Figure 1:
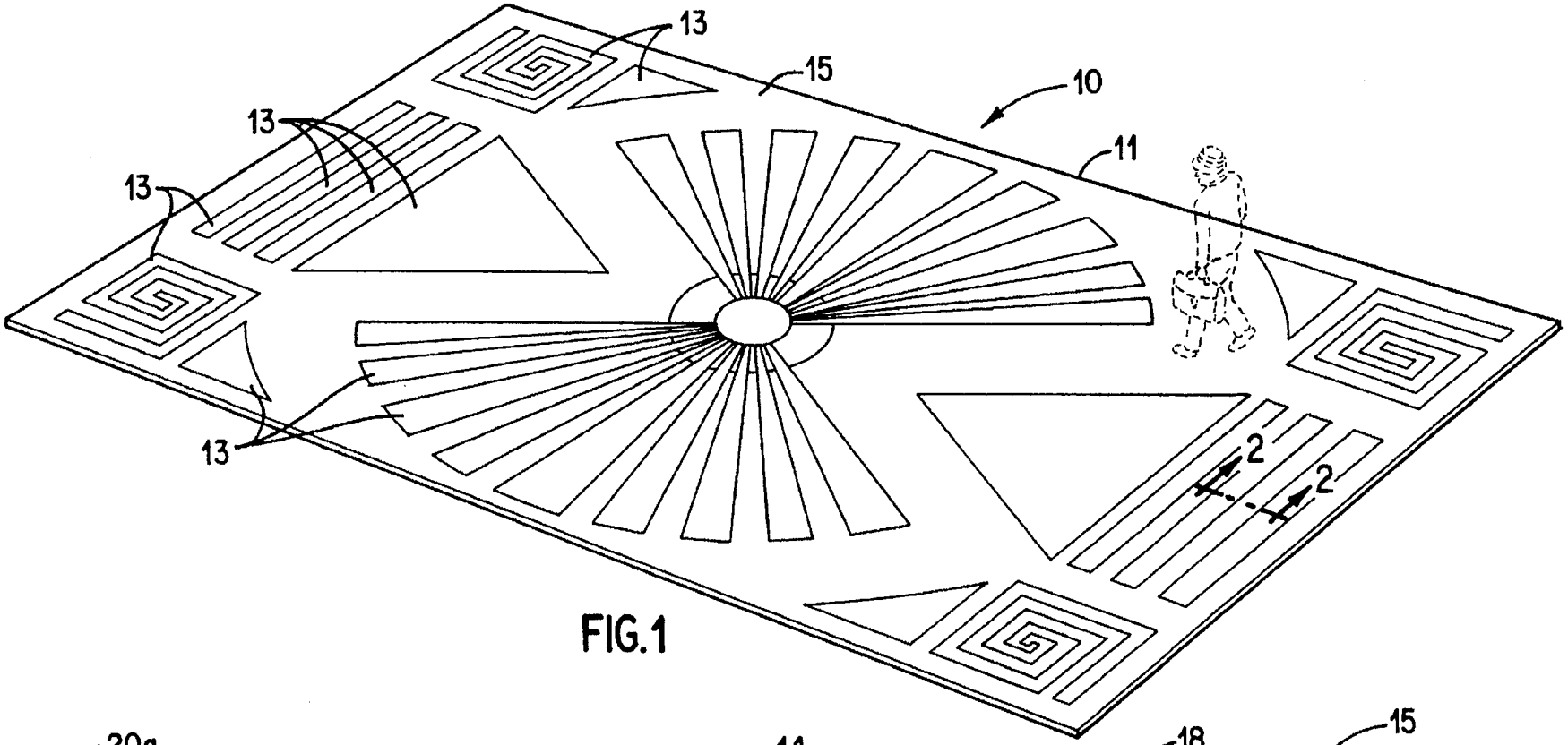
FIG. 1 is a perspective view of a substantially seamless textile substrate having a plurality of decorative inlays therein.
Figure 2:
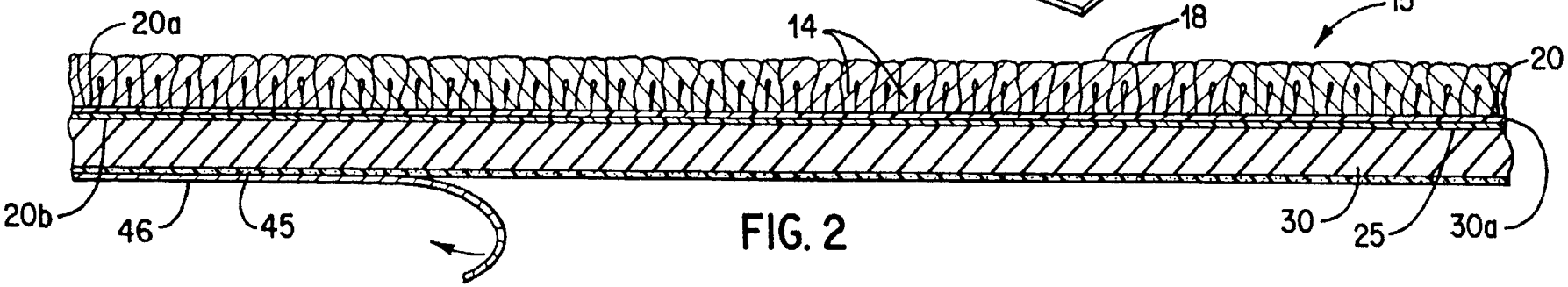
FIG. 2 is a side elevation view taken along lines 2—2 in FIG. 1.

The present invention is described more fully hereinafter with reference to the accompanying drawings, in which preferred embodiments of the invention may be shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout.

Referring to FIGS. 1–5, a textile substrate 10 having a plurality of decorative inlays 13 therein, and a method for making same, is illustrated. The textile substrate 10 comprises textile fibers 14 defining a fibrous face 15, a primary backing 20 to which the textile fibers are secured, and a secondary backing 30 secured to the primary backing. Textile substrates having a secondary backing are typically applied to hard floor surfaces, such as concrete, where a shock absorbent layer is needed between the primary backing and the hard floor surface.

For purposes of this invention, the term "textile substrate" relates to, but is not limited to, a fiber, web, yarn, thread, sliver, woven fabric, knitted fabric, non-woven fabric, upholstery fabric, tufted carpet, and pile carpet formed from natural and/or synthetic fibers. In a preferred embodiment, the textile substrate 10 is a tufted carpet 11 having a plurality of tufted carpet inlays 13. The tufted carpet 11 comprises a primary backing 20 having textile fibers 14 extending outwardly from an upper surface 20*a*, a first resin coating composition 25, a secondary backing 30, and optionally, a releasable adhesive layer 45 with a release cover 46. The textile fibers 14 are bonded to the primary backing 20 using a first resin coating composition 25, sometimes referred to as a "tuft-lock" coating. Methods for making a tufted carpet having a tuft-lock coating are disclosed in U.S. Pat. No. 3,695,987 to Wisotzky et al., and in U.S. Pat. No. 4,808,459 to Smith et al., the disclosures of which are incorporated herein by reference in their entirety.

In general terms, the textile fibers 14 are threaded through the primary backing 20, typically by needling, to form pile loops 18. The pile loops 18 are relatively loosely attached to the primary backing 20. A coating of a first resin coating composition 25 is applied to the lower surface 20*b* of the primary backing 20 and penetrates between the interstices of the pile loops 18 and the primary backing. Heat is then applied to the first resin coating composition 25 in order to fuse the first resin coating composition and the pile loops 18 to the primary backing 20. The term "fuse" indicates that the first resin coating composition 25, pile loops 18, and primary backing 20 are permanently bonded without requiring any external bonding agent, such as an adhesive.

Preferably, each tufted carpet inlay 13 is cut from material 31 comprising a primary backing 32 having textile fibers 33 extending outwardly from an upper surface 32*a*, a second resin coating composition 34, and a secondary backing 35. The textile fibers 33 are bonded to the primary backing 32 using a second resin coating composition 34, or "tuft-lock" coating.

Preferably, the tufted inlay material 31 is manufactured by a method similar to that for the tufted carpet 11. The textile fibers 33 are threaded through the primary backing 32, typically by needling, to form pile loops (not shown). The pile loops are relatively loosely attached to the primary backing 32. A coating of a second resin coating composition 34 is applied to the lower surface 32*b* of the primary backing 32 and penetrates between the interstices of the pile loops and the primary backing. Heat is then applied to the second resin coating composition 34 in order to fuse the resin coating composition and the pile loops to the primary backing 32.

Preferably, the first and second resin coating compositions 25, 34 are a thermoplastic material and are the same. Thermoplastic materials are not subject to chemical change when heated. Thermoplastic materials are not infusible, consequently they will gel or soften when a solvent is applied. Suitable polymers are derived from at least one monomer selected from the group consisting of acrylic, vinyl, chlorinated vinyl, styrene, butadiene, ethylene, butene, and copolymers or blends thereof. A preferred first and second resin coating composition 25, 34 is a polymer or copolymer of a vinyl compound, e.g., polyvinyl chloride, polyvinylidine chloride, polyethylene chloride, polyvinyl acetate, polyvinyl acetal, etc., and copolymers and mixtures thereof. A preferred specific example of a first and second resin coating composition 25, 34 is a vinyl chloride, resin-based plastisol, wherein the plasticizer component of the plastisol is a phthalate-based compound, such as an alkyl phthalate substituted one or two times with a linear or branched $C_5$–$C_{12}$ alkyl group, which is included in an amount by weight equal to between about 15 to 60 percent of the weight of the vinyl chloride resin component. Particularly preferred vinyl chlorides include Vinycel 124 (Policyd SA DE CV, Mexico), Geon® 13 oz (Geon Company, Cleveland, Ohio), Pliovic M-70 (The Goodyear Tire and Rubber Company, Akron, Ohio), and Oxy 67SF (Occidental Chemical Corp., Dallas, Tex.). Particularly preferred alkyl phthalate plasticizers include Santicizer® 160 (Monsanto Company, Saint Louis, Mo.), Palatinol® 711P (BASF Corporation, Parsippany, N.J.), and Jayflex DHP (Exxon Chemical America, Houston, Tex.). The first and second resin coating compositions 25, 34 can be applied as a unitary layer, or one or more additional layers of the same or different resin coating compositions can be applied. For example, a highly filled composition can be applied, followed by application of a less filled resin coating composition.

After the pile loops 18 and first resin coating composition 25 are fused to the primary backing 20 of the tufted carpet 11, additional heat is applied to the resin coating composition and a relatively cold secondary backing 30 is contacted with the heated first resin coating composition. The temperature of the heated first resin coating composition 25 is sufficient to melt the contacting surface 30*a* of the secondary backing 30, thereby bonding the secondary backing to the first resin coating composition and creating an integral structure.

Similarly, after the pile loops and second resin coating composition 34 are fused to the primary backing 32 of the tufted inlay material 31, additional heat is applied to the second resin coating composition and a relatively cold secondary backing 35 is contacted with the heated second resin coating composition. The temperature of the heated second resin coating composition 34 is sufficient to melt the contacting surface 35*a* of the secondary backing 35, thereby bonding the secondary backing to the second resin coating composition and creating an integral structure.

Preferably, the secondary backings 30, 35 used for the tufted carpet 11 and inlay material 31 are formed of a foam polymer or copolymer. Suitable foam compositions include polymers derived from at least one monomer selected from the group consisting of ethylene, propylene, isobutylene, vinyl chloride, and copolymers or blends thereof. The secondary backings 30, 35 can be a neat or blended resin or can be filled with organic or inorganic fillers. Exemplary inorganic fillers can be in fibrous, flake, crystalline, amorphous, hollow, powder, or particulate form. Exemplary fillers include calcium carbonate, calcium sulfate particles, magnesium oxide, magnesium hydroxide, perlite, synthetic mica, vermiculite, clays, thermally stable carbon fibers, zinc oxide, dawsonite, low density hollow spheres of calcium carbonate, glass spheres, glass bubbles, thermally stable carbon microspheres, alumina, recycled fly ash, low density processed calcium carbonate such as Duvall 85 (Franklin Limestone Company, Nashville, Tenn.).

Preferably, the method includes the additional step of applying a releasable adhesive layer 35 to the secondary backing 30 of the textile substrate. A cover 46 releasably secured to the layer of pressure sensitive adhesive 45 protects and maintains the tackiness of the adhesive layer before laying the textile substrate 10 on an underlying floor. The cover 46 preferably is formed of a flexible plastic material such as a linear low density polyethylene having inherent stretchability. U.S. Pat. No. 4,849,267 to Ward et al. discloses a carpet having a pressure sensitive layer thereon for releasably securing the carpet to an underlying floor, the disclosure of which is incorporated herein by reference in its entirety.

Preferably, the tufted inlay material 31 includes a releasable adhesive layer (not shown) applied to the secondary backing 35. A cover (not shown) is preferably releasably secured to the layer of adhesive to protect and maintain the tackiness of the adhesive layer.

An oleophobic pressure sensitive adhesive 45 is preferred. The term oleophobic indicates a pressure sensitive adhesive which is not adversely affected by the plasticizer migration inherent in the vinyl plastisol secondary backings 30, 35, which also has high shear strength for preventing slippage between the floor covering and an underlying floor, and which has low tensile strength to facilitate removal and replacement of the floor covering by permitting peeling of the floor covering from the floor. The affinity and cohesiveness of the oleophobic adhesive layer 45 for the secondary backings 30, 35 is greater than that for an underlying floor to permit removal and replacement of the floor covering without any appreciable amount of adhesive being removed from the secondary backing and left on the floor.

Preferably, the oleophobic pressure sensitive adhesive 45 used with the secondary backings 30, 35 comprises a polymer or copolymer of at least one ethylenically unsaturated monomer. Particularly suitable are pressure sensitive adhesives derived from acrylic monomers. Exemplary acrylic monomers include alkyl esters of acrylic acid with an alkyl group having from 1 to 18 carbon atoms, including methyl, ethyl, n-butyl, sec-butyl, the various isomeric pentyl, hexyl, heptyl, and octyl (especially 2-ethylhexyl), lauryl, cetyl, stearyl, and like groups; and alkyl esters of methacrylic acid with an alkyl group having from 4 to 18 carbon atoms, including n-butyl, n-hexyl, 2-ethylhexyl, n-octyl, lauryl, cetyl, stearyl, and like groups. These monomers are selected to provide the high shear strength and low tensile strength needed as would be understood by one skilled in the art. One particularly suitable oleophobic pressure sensitive adhesive which, from testing, is deemed to be commercially acceptable is an 80/20 copolymer of butyl acrylate/2-ethyl hexyl acrylate.

Figure 3:
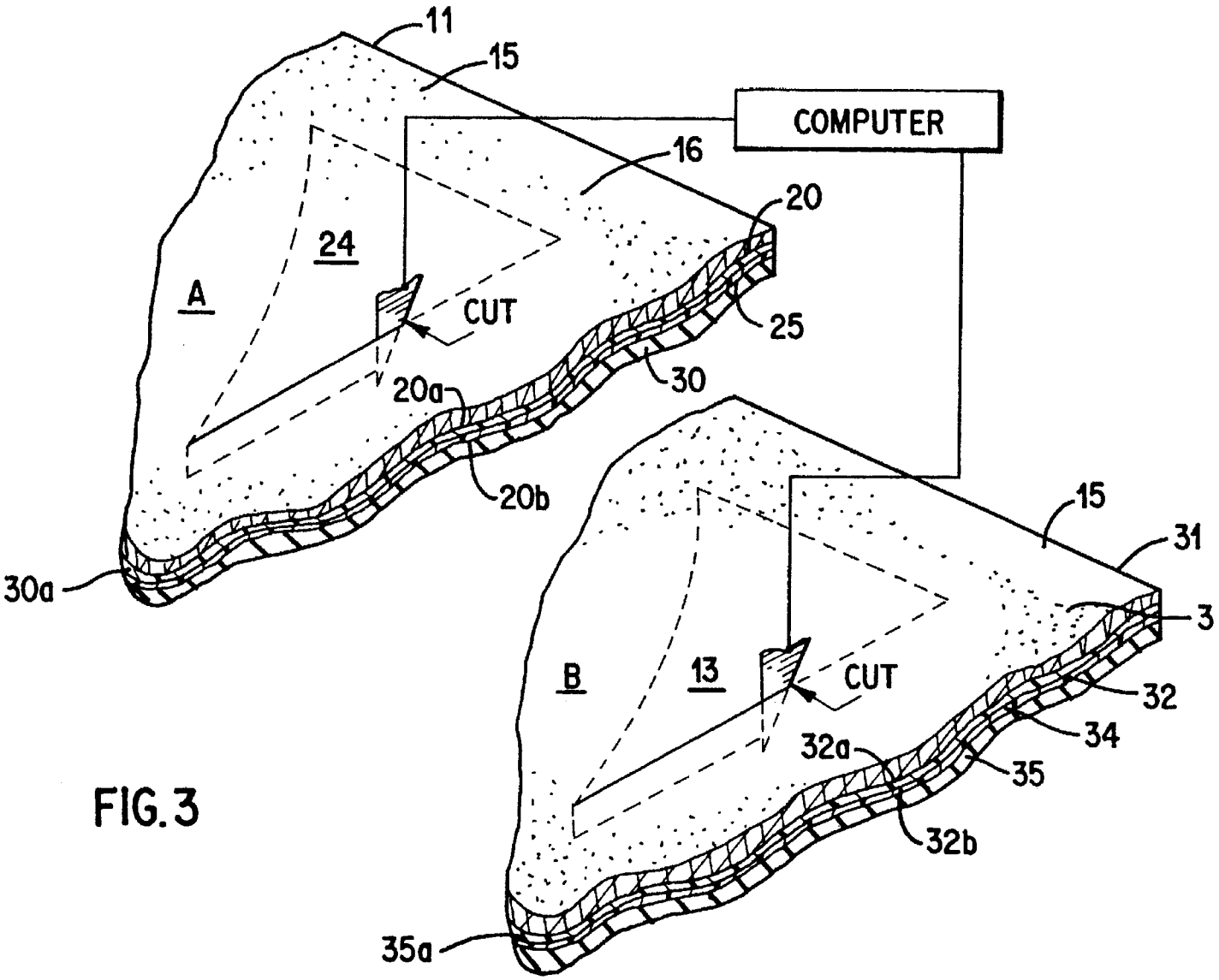
FIG. 3 is a fragmentary perspective view illustrating the steps of cutting a textile substrate "A" to create an opening and cutting a second textile substrate "B" to create an inlay.
Figure 4:
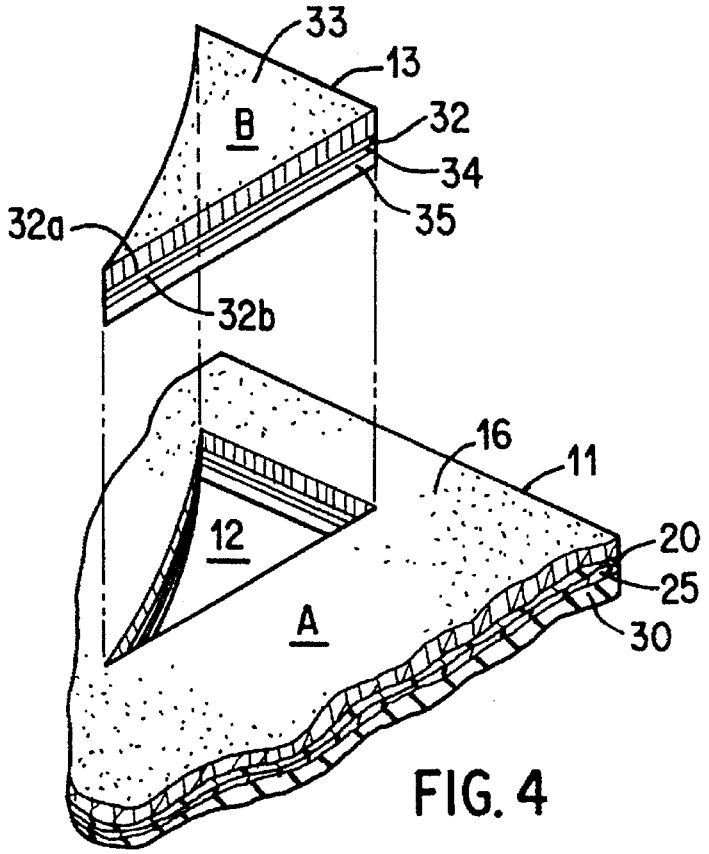
FIG. 4 is an exploded perspective view illustrating the insertion of the inlay into the textile substrate opening.
Figure 5:
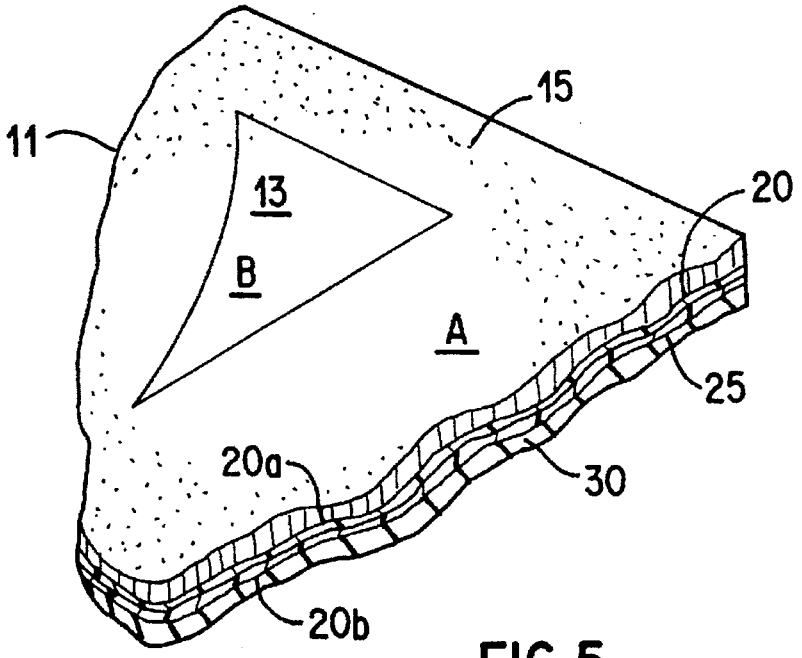
FIG. 5 is a fragmentary perspective view of a substantially seamless textile substrate having a decorative inlay therein.

Referring now to FIGS. 3–5, a method of making an inlaid tufted carpet 11 according to the present invention will be described. The method comprises the steps of cutting and removing a first portion 24 from the tufted carpet 11 thereby creating an opening 12; providing an inlay 13 substantially identical in shape and size as the opening 12; inserting the inlay 13 into the opening 12 created in the tufted carpet 11 such that the inlay 13 and the opening 12 substantially coincide; and fusing the inlay 13 and the tufted carpet 11 to create a substantially seamless inlaid carpet. In a preferred embodiment, these steps are performed at a plurality of locations on the tufted carpet 11.

Preferably, the inlay design for each carpet is created initially, and comprises creating the shape of each inlay, selecting colors for each inlay, and laying out the repeat pattern of the inlay or inlays for a particular carpet. Preferably, creation of the art is performed and stored on a computer.

Tufted carpet 11, manufactured as described above with a tuft-lock coating, is conveyed from a carpet source, such as a roll, and positioned on a cutting table (not shown). A portion 24 is cut from the tufted carpet 11, in accordance with the inlay design, to produce an opening 12 therein. An inlay 13, having a substantially identical shape as the cut portion 24, is cut from a second tufted carpet preferably manufactured as described above with a tuft-lock coating. Preferably, the carpet 11 to receive the inlay 13 and the tufted inlay material 31 from which the inlay is cut, are cut at approximately the same time. As would be understood by those having skill in the art, inlays could be cut prior to the time when the tufted carpet 11 is cut and then simply placed in each opening 12 of the carpet 11, as it is being cut.

As illustrated in FIG. 3, the portion 24 removed from the carpet 11 is substantially identical to the inlay 13 removed from the tufted inlay material 31. Furthermore, the removed portion 24 and inlay 13 each comprise a primary backing 20, 32, having textile fibers 14, 33 secured thereto, first and second resin coating compositions 25, 34, respectively, and secondary backing layers 30, 35, respectively. Preferably, the cross-sectional thickness of the cut carpet 11 and the inlay 13 are substantially identical so that the outwardly extending portions of the textile fibers 14, 33 of the carpet and inlay will be substantially flush when the inlay is aligned within the opening 12.

As would be understood by those having skill in the art, the inlay 13 may be cut at any time convenient during the manufacturing process. Cutting may be performed by various known devices including an ultrasonic cutting knife, a laser, a wire cutter, and a water jet. Highly accurate cutting is possible when performed by a computer-aided cutting device (FIG. 3). As would be understood by those having skill in the art, the cut made in the tufted carpet 11 is preferably of sufficiently narrow width such that substantially no gap exists between the cut portion 24 and the surrounding carpet 11 prior to removal of the cut portion. Consequently, an inlay 13, having a substantially identical shape as the removed portion 24, may fit within the opening 12 in the carpet 11 with substantially no gap, as well.

The carpet 11 and the inserted inlay 13 are immobilized to prevent misalignment during the fusing step. Preferably, the inlay 13 and carpet 11 are immobilized by removable adhesion to an adhesive substrate (not shown). Materials suitable as an adhesive substrate include paper, for example freezer paper, having a wax coating. Freezer paper has sufficient adhesion to hold the pieces in place as they are fused, but releasable enough to peel away rather easily when assembly is complete. Other acceptable adhesive substrates include plastic. The use of an adhesive substrate also facilitates the fusing of inlays in the field by the carpet installer. As would be understood by those having skill in the art, other methods of immobilization, including the use of pointed instruments, such as awls, to secure the inlay 13 and carpet 11 to a surface, may be utilized.

The fusing step preferably comprises applying a volatile solvent that gels or softens the first and second thermoplastic resin coatings, 25, 34 of the carpet 11 and the inlay 13 so that they will fuse permanently. The solvent chosen should be one which gels or softens both the first and second resin coating compositions 25, 34; and secondary backings 30, 35 of the carpet 11 and inlay 13 become permanently bonded without requiring any additional adhesive. Moreover, the solvent should be volatile so that it will flash off after application and softening of the thermoplastic compositions. A particularly suitable solvent is a ketone-based solvent sold under the tradename Seam Weld No. 54 by C & A Floor Coverings Division of Dalton, Ga.

After the inlay 13 is fused within the carpet 11, the carpet is advanced to the next position where another inlay is to be inserted and the above steps are repeated. The inlaid carpet may then be wound in a roll or further cut to meet installation needs as required.

In another embodiment of the method of producing inlaid tufted carpet according to the present invention, a plurality of inlays may be provided to the carpet installer along with templates for cutting matching portions from a carpet. Upon inserting the inlays into the carpet, the installer can fuse the inlays and carpet at the site of the installation. This provides the installer with the ability to customize the design and layout of inlays within a carpet.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A method of making a textile substrate characterized by having a decorative inlay therein, the textile substrate having an outer face, a primary backing to which the outer face is secured, and a secondary backing secured to the primary backing using a first thermoplastic resin coating composition, said method comprising the steps of:

(a) removing a first portion from the textile substrate thereby creating an opening wherein vertical side faces are exposed in the first thermoplastic resin;

(b) providing an inlay substantially identical in shape and size as the first portion and having an outer face, a primary backing to which the outer face is secured, and a secondary backing secured to the primary backing using a second thermoplastic resin coating composition, the second thermoplastic resin having vertical side faces;

(c) inserting the inlay into the opening created in the textile substrate such that the inlay and the opening substantially coincide; and (d) fusing the vertical side faces of the first thermoplastic resin with the vertical side faces of the second thermoplastic resin such that the inlay and the textile substrate are fused together, without a reinforcing material on the underside surfaces of the inlay and the textile substrate, to create a substantially seamless textile substrate having a decorative inlay therein.

2. The method of claim 1 wherein the first and second resin coating compositions are a polymer or copolymer of a vinyl compound.

3. The method of claim 2 wherein the polymer of a vinyl compound is a polyvinyl chloride.

4. The method of claim 1 wherein said step (a) of removing a first portion comprises cutting the textile substrate and is performed by means selected from the group consisting of an ultrasonic cutting knife, laser, wire cutter, and water jet.

5. The method of claim 1 wherein said step (b) of providing an inlay comprises cutting and removing the inlay from a second textile substrate substantially concurrently with said step (a).

6. The method of claim 1 wherein said step (a) of removing a first portion from a textile substrate and said step (b) of providing an inlay are performed under computer control.

7. The method of claim 1 wherein said step (d) includes immobilizing the textile substrate and the inlay.

8. The method of claim 7 wherein immobilization during said step (d) occurs by removable adhesion of the textile substrate and inlay to an adhesive substrate.

9. The method of claim 1 wherein said step (d) includes applying a volatile solvent to the first and second thermoplastic resin coating compositions.

10. The method of claim 1 wherein said steps (a) through (d) are performed at a plurality of locations on the textile substrate.

11. The method of claim 1 including the additional step of applying a releasable adhesive layer to the secondary backing of the textile substrate and inlay after said step (d).

12. The method of claim 11 wherein a release cover is applied to the releasable adhesive layer.

13. The method of claim 11 wherein the releasable adhesive is an oleophobic pressure sensitive adhesive.

14. A method of making a tufted carpet characterized by having a decorative inlay therein, the tufted carpet having a primary backing and textile fibers extending from the primary backing, and a secondary backing secured to the primary backing using a first thermoplastic resin coating composition, said method comprising the steps of:

(a) removing a first portion from the carpet, thereby creating an opening wherein vertical side faces are exposed in the first thermoplastic resin;

(b) providing an inlay substantially identical in shape and size as the first portion and having a tufted outer face, a primary backing to which the outer face is secured, and a secondary backing secured to the primary backing using a second thermoplastic resin coating composition, the second thermoplastic resin having vertical side faces;

(c) inserting the inlay into the opening created in the tufted carpet such that the inlay and the opening substantially coincide;

(d) fusing the vertical side faces of the first thermoplastic resin with the vertical side faces of the second thermoplastic resin such that the inlay and the carpet are fused together, without a reinforcing material on the underside surfaces of the inlay and the carpet, to create a substantially seamless tufted carpet having a decorative inlay therein.

15. The method of claim 14 wherein the first and second resin coating compositions are a polymer or copolymer of a vinyl compound.

16. The method of claim 14 wherein the polymer of a vinyl compound is a polyvinyl chloride.

17. The method of claim 14 wherein said step (a) of removing a first portion comprises cutting the carpet and is performed by means selected from the group consisting of an ultrasonic cutting knife, laser, wire cutter, and water jet.

18. The method of claim 14 wherein said step (b) of providing an inlay comprises cutting and removing the inlay from a second carpet substantially concurrently with said step (a).

19. The method of claim 14 wherein said step (a) of removing a first portion from a carpet and said step (b) of providing an inlay are performed under computer control.

20. The method of claim 14 wherein said step (d) includes immobilizing the tufted carpet and the inlay.

21. The method of claim 20 wherein immobilization during said step (d) occurs by removable adhesion of the carpet and inlay to an adhesive substrate.

22. The method of claim 14 wherein said step (d) includes applying a volatile solvent to the first and second thermoplastic resin coating compositions.

23. The method of claim 14 wherein said steps (a) through (d) are performed at a plurality of locations on the tufted carpet.

24. The method of claim 14 including the additional step of applying a releasable adhesive layer to the secondary backing of the tufted carpet and inlay after said step (d).

25. The method of claim 24 wherein a release cover is applied to the releasable adhesive layer.

26. The method of claim 24 wherein the releasable adhesive is an oleophobic pressure sensitive adhesive.

* * * * *